US005329098A

United States Patent [19]

Howard et al.

[11] Patent Number: 5,329,098

[45] Date of Patent: Jul. 12, 1994

[54] OPEN COIL HEATER FOR EFFICIENT TRANSPORT

[75] Inventors: H. Keith Howard; Jimmy L. Sherrill, both of Cookeville, Tenn.

[73] Assignee: Adams Industries, Inc., Cookeville, Tenn.

[21] Appl. No.: 943,868

[22] Filed: Sep. 11, 1992

[51] Int. Cl.[5] ..... F24H 3/04; H05B 3/02; F26B 11/04

[52] U.S. Cl. ..... 219/532; 392/350; 392/389; 206/509; 206/350

[58] Field of Search ..... 219/532; 392/350, 485, 392/389; 338/296, 315, 318, 299, 296, 304-305, 318-320; 206/509, 515, 350

[56] References Cited

U.S. PATENT DOCUMENTS

| | | | |
|---|---|---|---|
| 1,047,742 | 12/1912 | Buchanan | 338/319 |
| 1,170,943 | 2/1916 | Swoboda | 219/532 |
| 1,313,258 | 8/1919 | Carmean et al. | 219/532 |
| 1,444,621 | 2/1923 | Lynn et al. | 219/532 |
| 1,695,801 | 12/1928 | Dibble . | |
| 1,844,678 | 2/1932 | Pickup . | |
| 2,588,812 | 3/1952 | Dougherty | 206/509 |
| 2,856,500 | 10/1958 | Hartman . | |
| 2,973,931 | 3/1961 | Brown | 108/53.3 |
| 3,616,943 | 11/1971 | Brink | 206/509 |
| 3,781,525 | 12/1973 | Joeckel | 219/532 |
| 3,790,751 | 2/1974 | Kuhn | 392/350 |
| 4,489,839 | 12/1984 | Epperson | 206/509 |
| 4,573,595 | 3/1986 | Mednis | 206/509 |
| 4,617,547 | 10/1986 | Howard et al. . | |

FOREIGN PATENT DOCUMENTS

| | | | |
|---|---|---|---|
| 2447840 | 4/1976 | Fed. Rep. of Germany . | |
| 2-110071 | 4/1990 | Japan | 206/509 |

*Primary Examiner*—Philip H. Leung
*Assistant Examiner*—John A. Jeffery
*Attorney, Agent, or Firm*—Dickinson, Wright, Moon, Van Dusen & Freeman

[57] ABSTRACT

An electric heater includes an electric heating coil that extends above the sidewalls of an air flow channel. The coil is formed in sections that extend transversely to the channel and are spaced by the width of a coil section to allow two heaters to be arranged face to face for shipping. This arrangement is very efficient because one of the heaters provides protection to the coil of the other of the heaters to reduce packaging costs.

6 Claims, 4 Drawing Sheets

OPEN COIL HEATER FOR EFFICIENT TRANSPORT

TECHNICAL FIELD

This invention relates to the art of electric heaters. In particular the invention relates to the art of electric heaters designed for efficient shipping from manufacturer to user.

BACKGROUND

A heater wherein a housing supports an element for supporting a plurality of insulators for supporting, in turn, a helical heating element is shown in U.S. Pat. No. 4,617,547 (Howard). In this heater, the central axes of the helical coils extend in the direction of the air flow, which is dictated by the shape of the housing. The housing is generally U-shaped and is secured to another U-shaped element to form a channel for directing the flow of air in the longitudinal direction of the housing.

The heater shown in U.S. Pat. No. 4,617,547 is designed to be a self supporting channel, as when two U-shaped channel parts are secured together, or to be a part of another structure, as when one U-shaped section is secured to the other structure.

The structure shown in U.S. Pat. No. 4,617,547 employs wire-like elements to support the insulating elements. It has been suggested, however, to use plates to support the insulators. Examples are found in U.S. Pat. Nos. 1,695,801 (Dibble); 1,844,678 (Pickup); and 2,856,500 (Hartman).

SUMMARY OF THE INVENTION

A concern in the design and manufacture of a part is the manner in which the part is to be packaged and shipped. Parts which require a large amount of packaging generally cost more than those which require little or no packaging because of the cost of the packaging materials and the desire, or requirement, to recycle used packaging materials.

In accordance with the invention, a heater construction facilitates shipping with a minimum of packaging and yet provides an efficient heater. The heater of the invention provides a part of a channel that includes electric heating components, the channel being designed to be attached to a machine, such as a clothes dryer, for completing a channel that directs the flow of air to be heated. The heater of the invention is designed to provide the minimum amount of supporting structure required so that as much of the heater as is possible can be provided by the manufacturer of the machine and the smallest amount shipped by the manufacturer of the heater.

As noted above, a major consideration is that the heater be easily shipped with a minimum of packaging. The heater of the invention provides an advantage in this regard by the unique arrangement of the heater coil elements with respect to the channel. In particular, the heater coil is arranged to traverse the channel in a plurality of parallel courses, which courses are arranged across the channel, instead of along the channel as taught by the previously mentioned U.S. Pat. No. 4,617,547. The coil segments extend above the sidewalls of the heater, and the coil segments are spaced from each other by a distance that will allow a similar coil segment of a second heater to fit between the adjacent coil segments of the first heater during shipment. The maximum separation required between adjacent coils of a heater is the diameter of the helical coil. The separation may be less, however, in those instances where the coil extends above the sidewalls by less than the diameter of a coil.

The arrangement wherein the coil extends across the channel allows a pair of heaters to be stacked, one on top of the other in facing relationship, for shipping. Because the heater coil segments, or courses, extend across the channel, the upper channel can be stacked so that its sidewalls align in the transverse direction with those of the lower channel. The upper and lower channels are, of course, displaced with respect to each other slightly in the longitudinal direction when stacked.

Another feature of the invention is that the coils are supported, through intermediate insulators, by a plate that is mounted to the sidewalls of the channel. This plate has been discovered to provide superior transfer of heat from the electric coils to the air flowing in the channel in this arrangement. Other support mechanisms, such as wire frames, are acceptable, however, if stacking is the primary objective.

DETAILED DESCRIPTION OF THE PREFERRED EMBODIMENT

Figure 1:
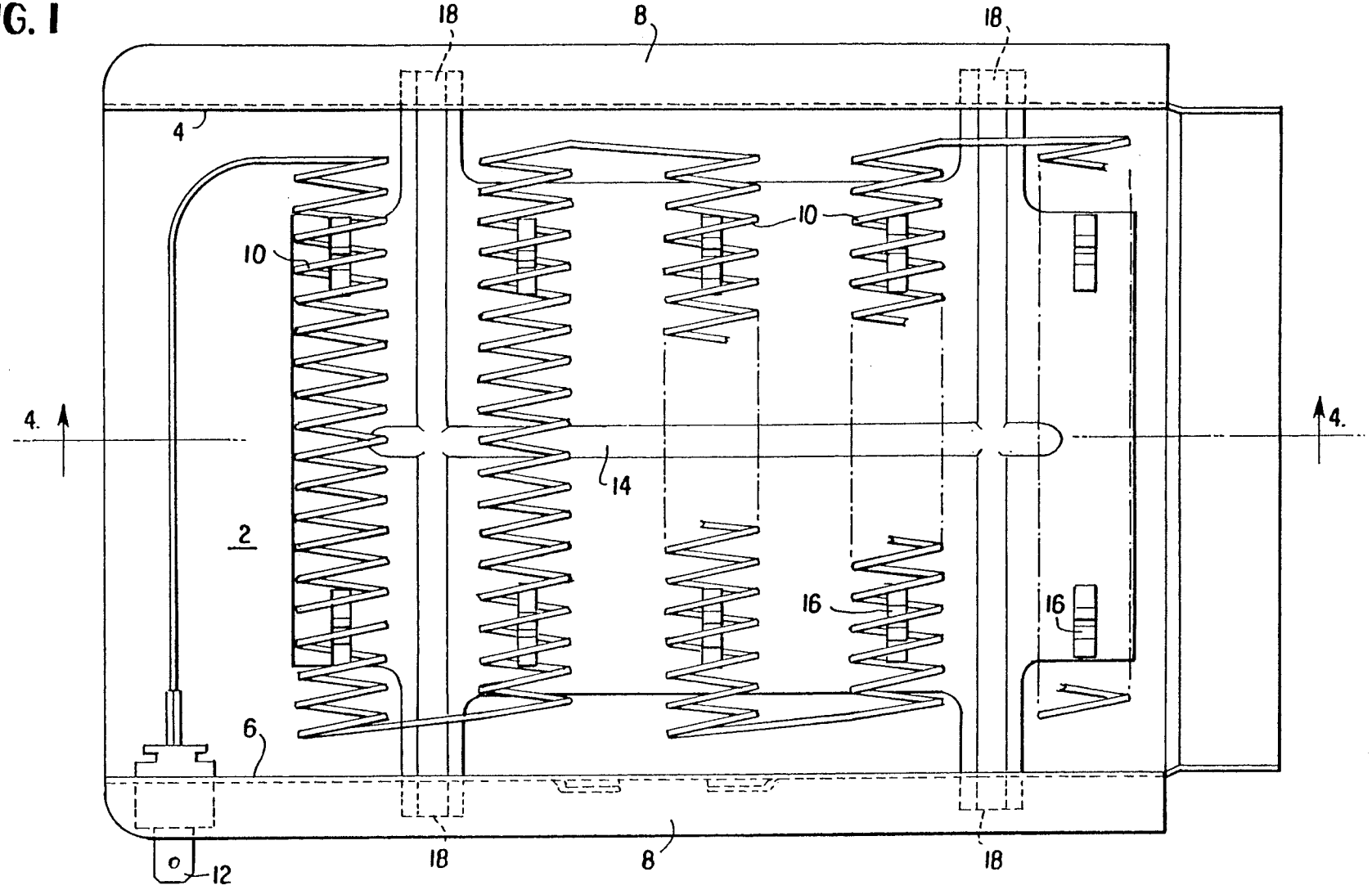
FIG. 1 is a top view of a heater in accordance with the invention.
Figure 2:
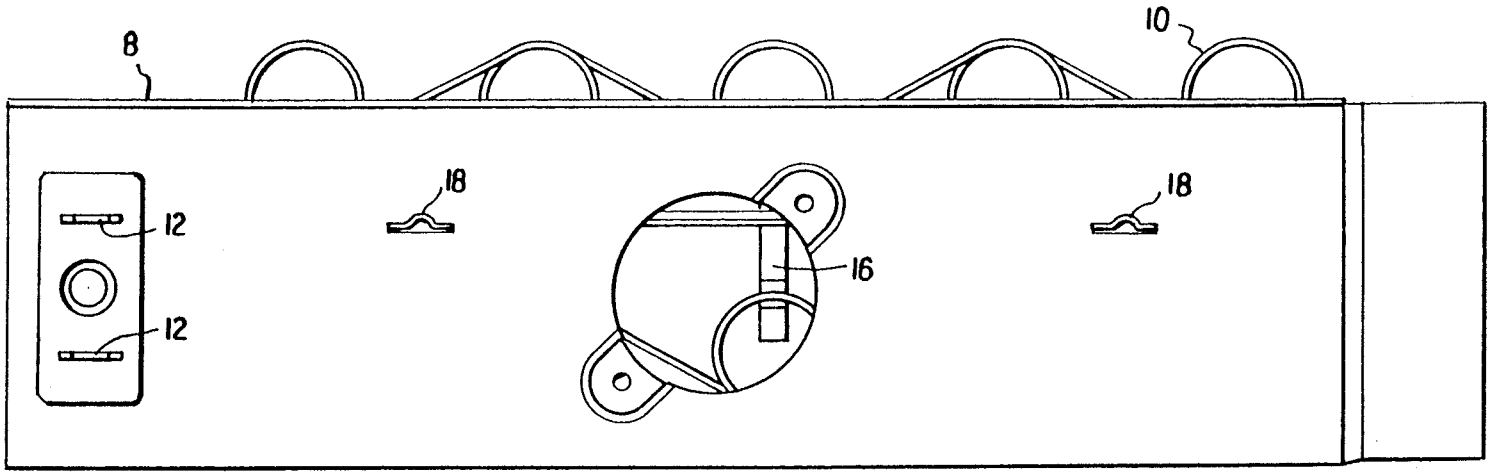
FIG. 2 is a side view of the heater shown in FIG. 1.
Figure 3:
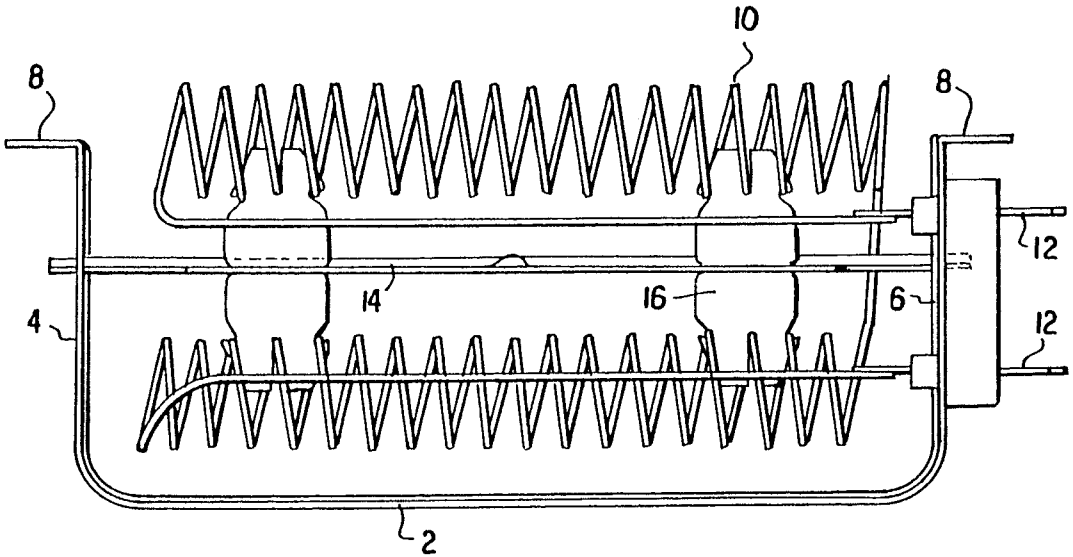
FIG. 3 is an end view of the heater shown in FIG. 1.
Figure 4:
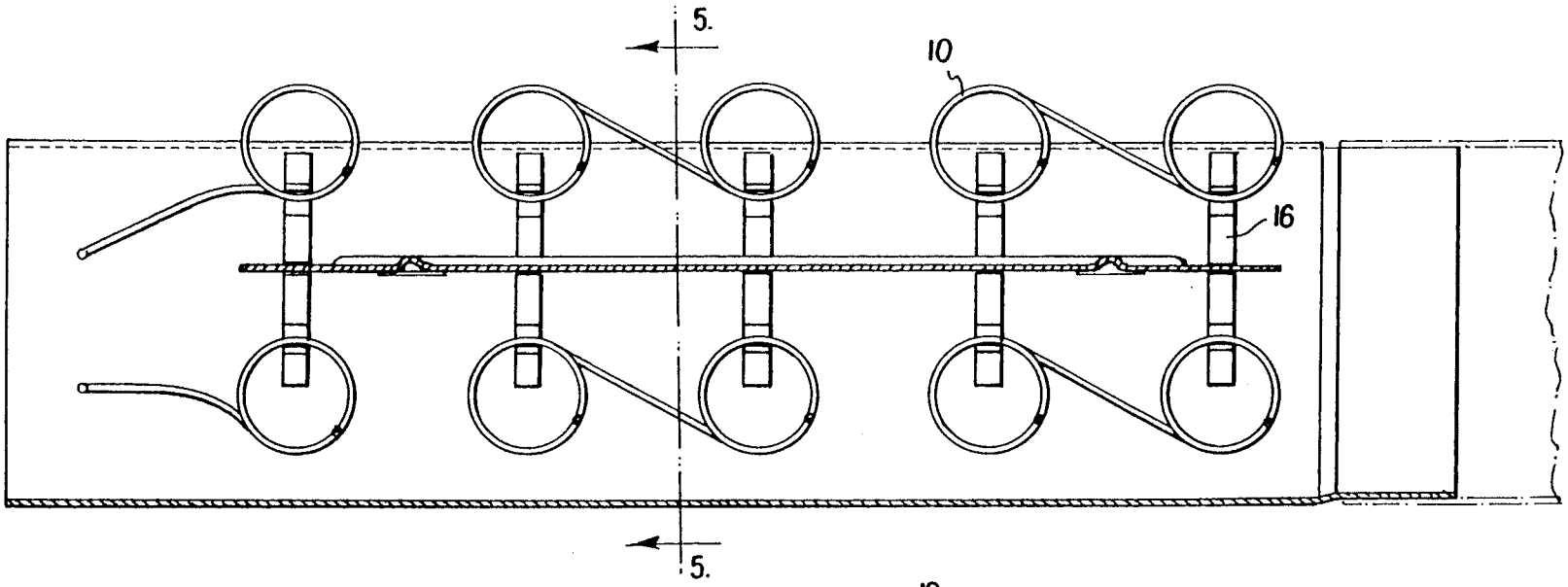
FIG. 4 is a cross section taken along line 4—4 of FIG. 1.
Figure 5:
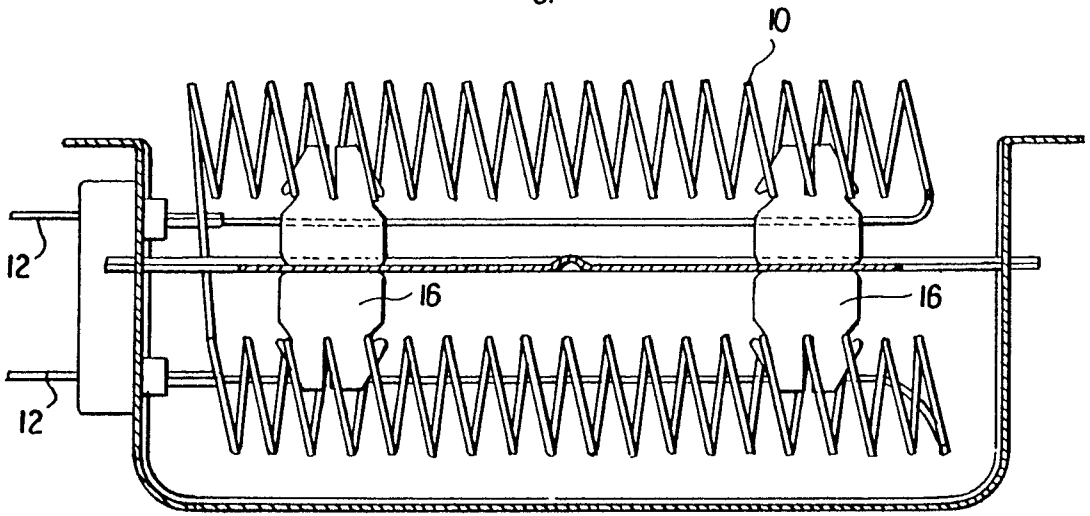
FIG. 5 is a cross section taken along line 5—5 of FIG. 4.

FIG. 1 shows an embodiment of a heater in accordance with the invention designed to be attached to a clothes dryer (not shown). The heater in accordance with the invention may, of course, be designed for use with other equipment. The heater includes a channel formed by a bottom wall 2 and opposed sidewalls 4 and 6. Each of the sidewalls includes a tab 8 at its upper edge for facilitating attachment of the channel to the frame of the clothes dryer. The tab is shown as extending outward, but may be of various shapes, depending on the circumstances.

The heater shown in the figures uses an electric heating coil 10 for heating air flowing through the channel in response to a blower in the clothes dryer. The coil is supplied with electricity through terminals 12 as is known in the art. The coil extends back and forth across the channel to provide a number of coil sections 10, for a purpose which will be explained fully below in connection with FIG. 6. It is also noted that the coils are regularly spaced by a distance which allows a coil segment from another heater to fit between adjacent coils.

The coil is supported within the channel by a metal plate 14, which in turn supports a number of ceramic insulators 16, which are known in the art. The plate 14 has projections 18, which extend through slots in the sidewalls 4 and 6 to support the plate on the sidewalls, but other attaching arrangements, such as welding, riveting, or the like may be used. The sidewalls are preferably capable of being separated slightly during assembly to accommodate the projections and then springing back to the position shown in the figures to maintain the engagement between the sidewalls and the projections.

FIGS. 2 through 5 illustrate the feature of the invention wherein the coil 10 extends above the tops of the sidewalls 4 and 6. This allows a greater part of the overall heater structure to be provided by the appliance to which the heat is to be supplied. In the preferred embodiment, for example, that appliance is a clothes dryer with a channel for cooperation with the channel formed by bottom 2 and sidewalls 4, 6 to make a closed channel, or duct, for the flow of heated air.

A problem with the construction of this type, where the heater coil extends above the top of the sidewalls, is that the coil is not protected by the sidewalls during shipment of the heaters. Thus, the heaters of this sort ordinarily require a significant amount of packaging to prevent damage to the exposed part of the coil, which extends above the sidewalls.

Figure 6:
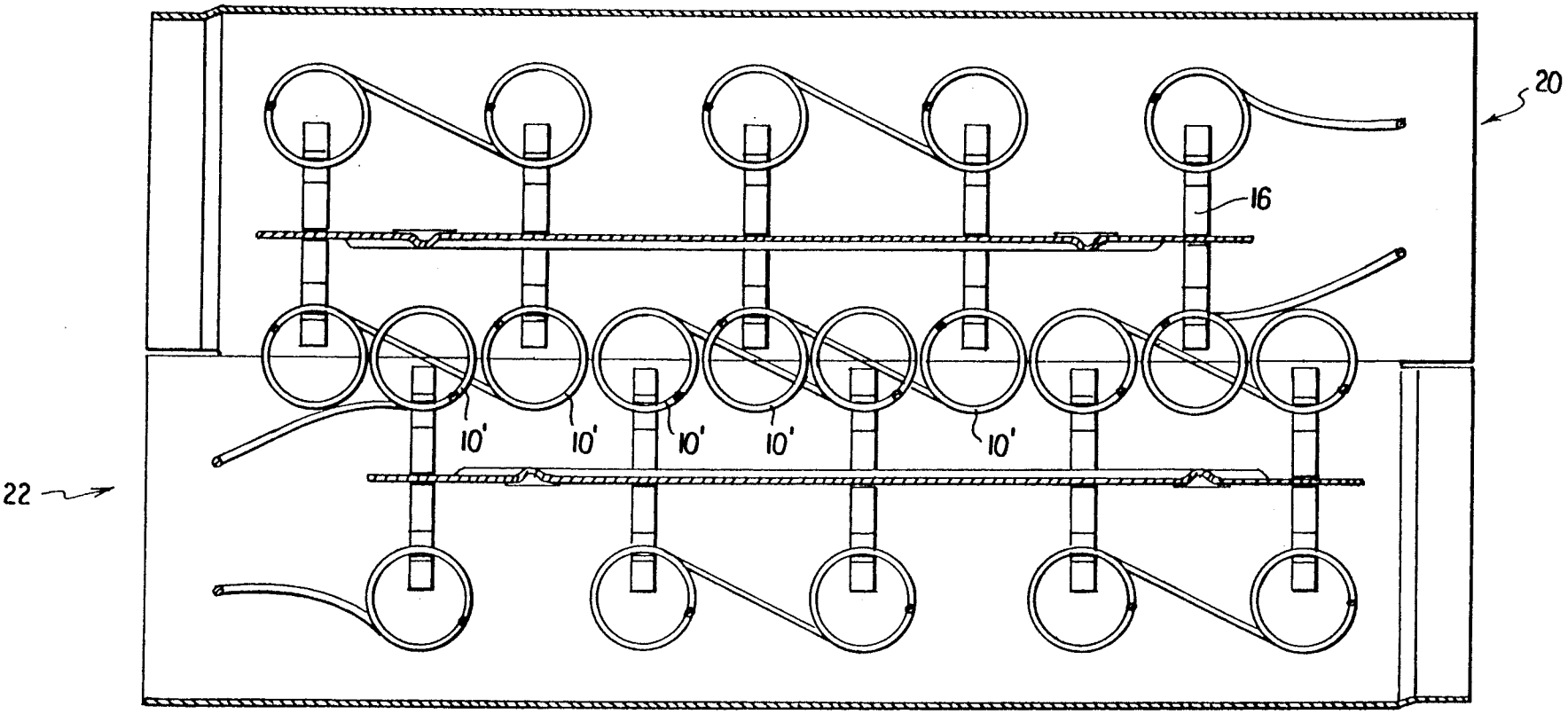
FIG. 6 is a longitudinal cross section of two heaters as shown in FIG. 1 in stacked relationship.

FIG. 6 illustrates how the invention overcomes this disadvantage by structure that permits two such heaters 20 and 22 to be arranged face-to-face during shipment. In this arrangement, the coils of the heaters are displaced in the longitudinal direction by a distance that corresponds to one-half the distance between adjacent coil centerlines. By this arrangement, the sidewalls and bottom of one channel provide protection for the exposed coil sections of the other heater. Moreover, the coils are arranged within the channel such that the ends of the two channels are aligned longitudinally even though the heater coils are displaced longitudinally. Because the two heaters 20 and 22 are not displaced laterally, the sidewalls of the two heaters align to provide a sturdy combination.

In a preferred arrangement for shipment, pairs of heaters are arranged as shown in FIG. 6, the heaters being arranged on pallets such that the longitudinal direction of the heaters is vertical. A number of these pairs is placed on the pallet to form a base layer, and a board, or separating pad, is placed on top of the base layer to support a second layer, and so on.

It will be appreciated that a unique heater design and method of shipment has been described. Modifications within the scope of the appended claims will be apparent to those of skill in the art.

We claim:

1. A heater comprising a channel formed by opposed sidewalls and a bottom wall for directing air flow in a first direction and an electric heater element comprising a coil extending across said channel in a second direction transverse to said first direction for heating air flowing in said channel, wherein at least a portion of said electric heater element extends above said sidewalls, a distance that the heater extends above the sidewalls is only sufficient to allow two of said heaters to be packed together in face-to-face relationship with the coils of both heaters nested together.

2. A heater according to claim 1 further including means for attaching said channel to an object.

3. A heater according to claim 2 wherein said means for attaching said channel to an object comprises a tab extending transverse to said sidewalls.

4. A heater according to claim 1 wherein said electric heater element comprises a plurality of sections, each of said sections having a width and extending across said channel in said second direction, and wherein adjacent ones of said sections are spaced from each other, by a distance no greater than said width.

5. A heater according to claim 1 further comprising support means for supporting said electric heater element, said support means comprising a plate of heat conducting material and electric insulating means between said plate and said electric heater element for electrically insulating said electric heater element from said plate.

6. A heater according to claim 4 wherein each of said sections is electrically connected to an adjacent section by a formed, straight wire section and said heater sections are helical coils.

* * * * *